US006267539B1

(12) United States Patent
Mihalcin

(10) Patent No.: US 6,267,539 B1
(45) Date of Patent: Jul. 31, 2001

(54) AUTOMATED MINING SYSTEM

(76) Inventor: Robert E. Mihalcin, 3404 Hollyhock Way, Tampa, FL (US) 33618

( * ) Notice: Subject to any disclaimer, the term of this patent is extended or adjusted under 35 U.S.C. 154(b) by 0 days.

(21) Appl. No.: 09/430,819

(22) Filed: Oct. 29, 1999

(51) Int. Cl.[7] ..... B65G 53/04; B65G 53/38

(52) U.S. Cl. ..... 406/38; 406/137; 406/194; 406/196

(58) Field of Search ..... 406/2, 38, 39, 406/31, 32, 108, 134, 136, 137, 146, 194, 196

(56) References Cited

U.S. PATENT DOCUMENTS 4,045,086 * 8/1977 Parkers et al. ..... 299/17 X
5,253,718 * 10/1993 Lawler ..... 175/20 X
5,879,057 * 3/1999 Schwoebel et al. ..... 299/17 X

* cited by examiner

*Primary Examiner*—Christopher P. Ellis
*Assistant Examiner*—Kenneth W Bower
(74) *Attorney, Agent, or Firm*—Arthur W. Fisher, III

(57) ABSTRACT

A system and apparatus for transporting a colloidal like mixture of mineral material and water from a mining site to a processing facility comprising at least one automated water gun discharging continuous high velocity stream of water into a mineral stockpile and slurry pit in a predetermined undulating pattern to facilitate the mixing and movement of the mineral material and water into a hydraulic pump inlet disposed behind a crushing grid within the slurry pit wherein the automated water gun is moveably mounted on a portable sled and in operative communication with a water supply conduit having a barrel selectively moveable through a predetermined range of vertical and horizontal motion by a vertical positioning device and a horizontal positioning device respectively.

26 Claims, 6 Drawing Sheets

AUTOMATED MINING SYSTEM

BACKGROUND OF THE INVENTION

1. Field of the Invention

A system and apparatus for transporting a colloidal like mixture of mineral material and water from a mining site to a processing facility.

2. Description of the Prior Art

U.S. Pat. No. 4,949,794 shows a control apparatus including means to position and move the controlled apparatus having a fluid discharge device for vertical and horizontal movement. The control apparatus comprises a control input, a joystick, a controlled apparatus position limit, and a switch for selecting manual and automatic position and movement; a computer, a memory for storing program, a device for receiving controlled apparatus position information and a device for generating and communicating electrical signals; first and second controlled apparatus position determining devices; first and second control remotely controlled electrically operating drive motors for adjusting and controlling movement to the controlled apparatus, and first and second current sensing devices interposed between said computer and the drive motors.

U.S. Pat. No. 4,708,395 teaches a method and apparatus for mining a location using a hydraulic monitor having a horizontal and vertical positionable control apparatus. The hydraulic monitor is connected to a source of high pressure water. Distance and direction measuring equipment are mounted on the monitor and controlled in a manner to scan the location. The output from the distance and direction measuring equipment is fed to a computer and a visual video display monitor. The computer converts the information from the distance and direction measuring equipment to a visual representation of the cavity being mined.

U.S. Pat. No. 3,639,003 comprises a high-pressure stream of leach solution directed against a mine waste dump or other mass of mineral-bearing material to be leached to dislodge and break up the material.

U.S. Pat. No. 2,998,199 discloses a hydraulic monitors of the type used in placer mining and fire fighting and more particularly relates to hydraulic motors arranged to utilize the reaction force of liquid discharge of the liquid about two angularly related axes.

U.S. Pat. No. 740,731 teaches an apparatus for mining phosphatic pebble comprising. a station having washing and cleaning apparatus for the material and a pump and motor therefor for elevating the material thereto, a pipe extending from the pump to the sump, and an auxiliary pump having an independent motor. The auxiliary pump is coupled with the pipe and intermediate the first-named pump and the sump end of the pipe and arranged in a plane considerably below that of the first-mentioned pump in the upper plane.

SUMMARY OF THE INVENTION

The present invention relates to a system and apparatus for transporting a colloidal like mixture of phosphate or other mineral materials suspended in water from a mining site to a processing facility through a pipeline. Mineral materials are mechanically extracted from the ground by a dragline or other excavating equipment and deposited in a stockpile adjacent to a slurry pit near the mining area. The mineral materials in the stockpile are then washed into the slurry pit by complementary undulating high velocity streams of water discharged by at least two automated water guns positioned on opposing sides of the slurry pit. Once in the slurry pit, the mineral materials are mixed with water discharged from the opposing automated water guns to form a colloidal like water-mineral matrix that flows by gravity through a crushing grid to a hydraulic pump inlet disposed within the slurry pit. Of course, a single automated water gun may be used.

Each automated water gun is mounted on a portable sled in operative communication with a water supply conduit. The sled can be selectively positioned adjacent to the slurry pit by wheel loaders or track-mounted heavy equipment typically used in mining operations. Each automated water gun includes a barrel moveable through a selectable range of vertical and horizontal motion sufficient to allow water discharged from the outlet thereof to be directed against the stockpile of mineral material, the surface of the slurry pit and the crushing grid surrounding the hydraulic pump inlet. Movement of each water gun barrel is accomplished by a corresponding vertical positioning device and a horizontal positioning device. The vertical positioning device and the horizontal positioning device each comprises a hydraulic cylinder in operative communication with an electrically driven hydraulic power unit mounted on the portable sled. The movement of each water gun barrel is controlled by a logic circuit coupled to a corresponding electromechanical valve within the hydraulic system connecting the horizontal positioning device and vertical positioning device to the electrically driven hydraulic power unit.

A remote control panel is provide in a portable control room mounted on a sled or off-road truck which can be positioned near the slurry pit at distance sufficient to protect the operator and control room from the dragline dump bucket and debris or high pressure water escaping the slurry pit. A camera positioned on a telescoping mast mounted the top of the control room is operatively coupled to a video monitor in the control room to allow observation of the automated water cannons by a human operator. A series of floodlights operatively coupled to the remote control panel are positioned around the slurry pit to facilitate nighttime operation of the water guns.

To control the matrix production process, the operator monitors the operation of the automated opposing water guns through a window and the video monitor in the portable control room. In order to vary the pattern of movement in the water gun barrels, the operator selectively presses a switch on the control panel corresponding to the desired pattern of movement. Once a particular pattern has been selected, the automated water guns will continue to cycle automatically through that pattern of motion until the operator halts the operation of the water guns or selects a new pattern of motion. Alternatively, the operator may elect to control the movement of the water gun barrels manually with the pattern of motion corresponding in real time to control inputs through a joystick or other input means on the control panel.

In operation, mineral material is deposited in a stockpile on the edge of the slurry pit by a dragline or excavating equipment. Streams of high velocity water discharged from the barrels of the automated water guns are periodically directed to the base of the stockpile in recurring undulating patterns thereby causing mineral material on the edge of the stockpile to slough off into the slurry pit. Depending upon the consistency and stability stockpile, the operator can choose from a number of predetermined patterns of motion of the barrel of the automated water guns thereby modulating the rate at which mineral materials slough off of the stockpile and into the slurry pit.

Streams of high velocity water discharged from the barrels of the automated water guns are further periodically directed to the surface of the slurry pit in complimentary undulating patterns mixing the mineral material and water into a matrix. By periodically selecting between a series of predetermined patterns of motion in each water gun, the mineral materials are maintained in suspension within the matrix and the operator can maintain a steady flow of the colloidal like water-mineral matrix to the hydraulic pump. In addition to scouring the edge of the stockpile and matrix within the slurry pit, the operator may also select predetermined patterns which direct streams of high velocity water to the face of the crushing grid and hydraulic pump inlet to remove any debris or clumps of material blocking the flow of matrix through the grid.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
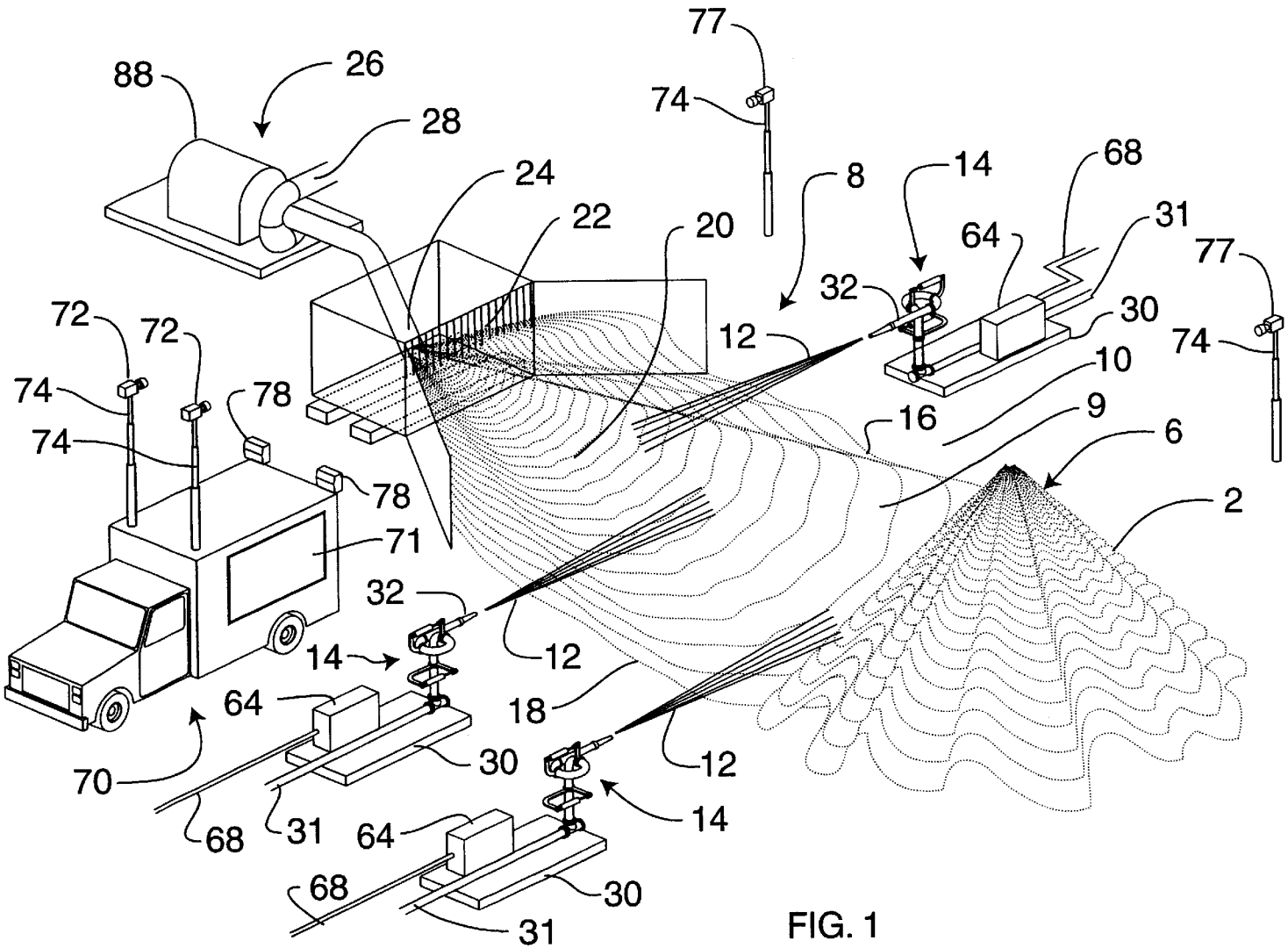
FIG. 1 is a perspective view of the system and apparatus of the present invention with a dry mineral stockpile and a slurry pit.
Figure 2:
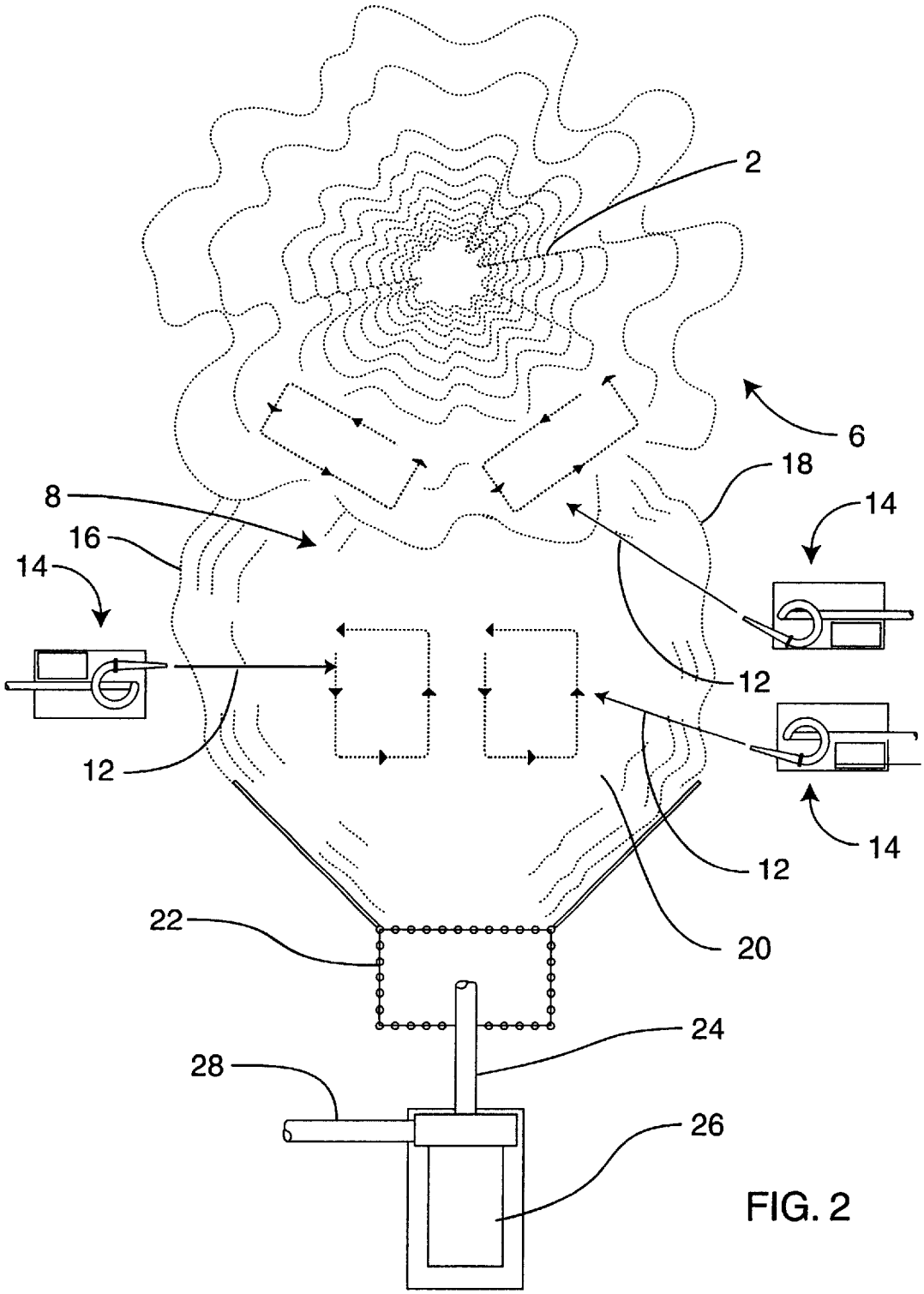
FIG. 2 is a top view of the system and apparatus of the present invention with a dry mineral stockpile and a slurry pit.

As best shown in FIGS. 1 and 2, the present invention relates to a system and apparatus for transporting a colloidal like mixture of phosphate or other mineral materials suspended in water from a mining site to a processing facility through a pipeline. Mineral materials 2 are mechanically extracted from the ground by a dragline or other excavating equipment (not shown) and deposited in a dry mineral stockpile generally indicated as 6 adjacent to a slurry pit generally indicated as 8 formed in the ground 10 in or adjacent to the mining area. The mineral materials 2 in the dry mineral stockpile 6 are washed into the slurry pit 8 by complementary undulating high velocity streams of water 12 discharged by opposing automated water guns each generally indicated as 14 positioned on opposite sides 16 and 18 of the slurry pit 8. Once in the slurry pit 8, the mineral materials 2 are mixed with water discharged from the opposing automated water guns 14 against the slurry surface 9 to form a colloidal like water-mineral mixture 20 that flows by gravity through a crushing grid 22 to a hydraulic pump inlet conduit 24 disposed within the slurry pit 8. The colloidal like water-mineral mixture 20 is drawn through the hydraulic pump inlet conduit 24 into a water-mineral mixture pump 26 and fed through a mixture supply conduit 28 to the processing facility (not shown).

Figure 3:
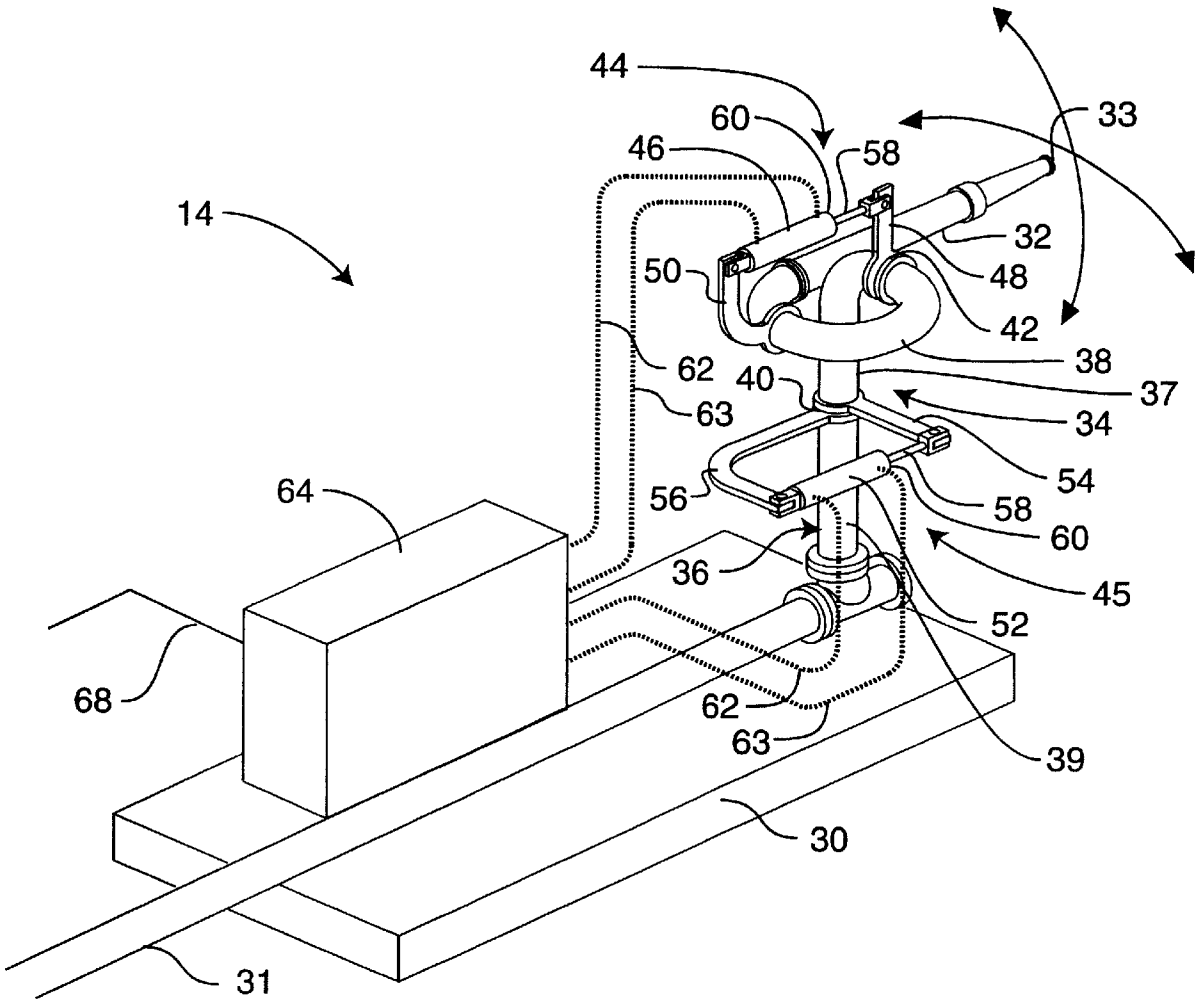
FIG. 3 is a detailed perspective view of an automated water gun of the present invention.

As shown in FIGS. 1 through 3, each automated water gun 14 is mounted on a portable sled 30 in operative communication with a corresponding water supply conduit 31. The portable sled 30 can be selectively positioned adjacent to the slurry pit 8 by wheel loaders or rack-mounted heavy equipment typically used in mining operations (not shown). As best shown in FIG. 3, each automated water gun 14 includes a water gun barrel 32 with a high pressure discharge nozzle 33 formed on an articulated supply pipe generally indicated as 34 comprising a straight substantially vertical supply tube generally indicated as 36 including an upper or first supply tube section 37 and a lower or second supply tube section 39 and a substantially horizontal curvilinear supply tube 38. A first water-tight swivel joint 40 is formed between the upper or first supply tube section 37 and the lower or second supply tube section 39 of the straight substantially vertical supply tube 36 and a second water-tight swivel joint 42 is formed in the substantially horizontal curvilinear supply tube 38. Through selective articulation of the first water-tight swivel joint 40 and the second water-tight swivel joint 42, the water gun barrel 32 is moveable through a selectable range of vertical and horizontal motion by a pattern positioning device comprising a first positioning mechanism generally indicated as 44 and a second positioning mechanism generally indicated as 45 respectively sufficient to allow water discharged from the high pressure discharge nozzle 33 to be directed against the dry mineral stockpile 6, the surface 9 of the slurry pit 8 and the crushing grid 22 surrounding the hydraulic pump inlet conduit 24.

Vertical pattern movement of each water gun barrel 32 is accomplished by the vertical or first positioning mechanism 44 comprising a first positioning assembly generally indicated as 46 operatively coupled between a first vertical control arm 48 rigidly attached to the substantially horizontal curvilinear supply tube 38 on one side of the second water-tight swivel joint 42 and a second vertical control arm 50 rigidly coupled to the substantially horizontal curvilinear supply tube 38 on the other side of the second water-tight swivel joint 42. Horizontal pattern movement of each water gun barrel 32 is accomplished by the horizontal or second positioning mechanism 45 comprising a second positioning assembly generally indicated 52 operatively coupled between a first horizontal control arm 54 rigidly attached to the first supply tube section 37 on one side of the first water-tight swivel joint 40 and a second horizontal control arm 56 rigidly attached to the supply tube section 39 on the other side of the first water-tight swivel joint 40. The horizontal or second positioning mechanism 45 selectably moveable through a predetermined horizontal range of substantially 105 degrees.

Each positioning assembly 46 or 52 comprises a first element or connecting rod 58 and a second element or hydraulic cylinder 60 movably coupled to each other and to the corresponding first and second vertical control assembly 48 and 50, and the corresponding first and second horizontal control arms 54 and 56 respectively.

Operation of the vertical positioning mechanism 44 and horizontal positioning mechanism 45 involves the selective introduction of high pressure hydraulic fluid to the corresponding hydraulic cylinder 60 extending or retracting the corresponding connecting rod 58. Hydraulic fluid is circulated through the corresponding hydraulic cylinder 60 by a supply conduit 62 and a return conduit 63 in operative communication with the corresponding hydraulic cylinder 60 and hydraulic pump (not shown) disposed within a cabinet 64 mounted on the portable sled 30. The hydraulic pump (not shown) is powered by an electric motor (not shown) also disposed within the cabinet 64. Electromechanical valves (not shown) common in the art are disposed between the supply conduit 62 and the return conduit 63 and the hydraulic pump (not shown) to control the flow of hydraulic fluid to and from the corresponding hydraulic cylinder 60.

Figure 4:
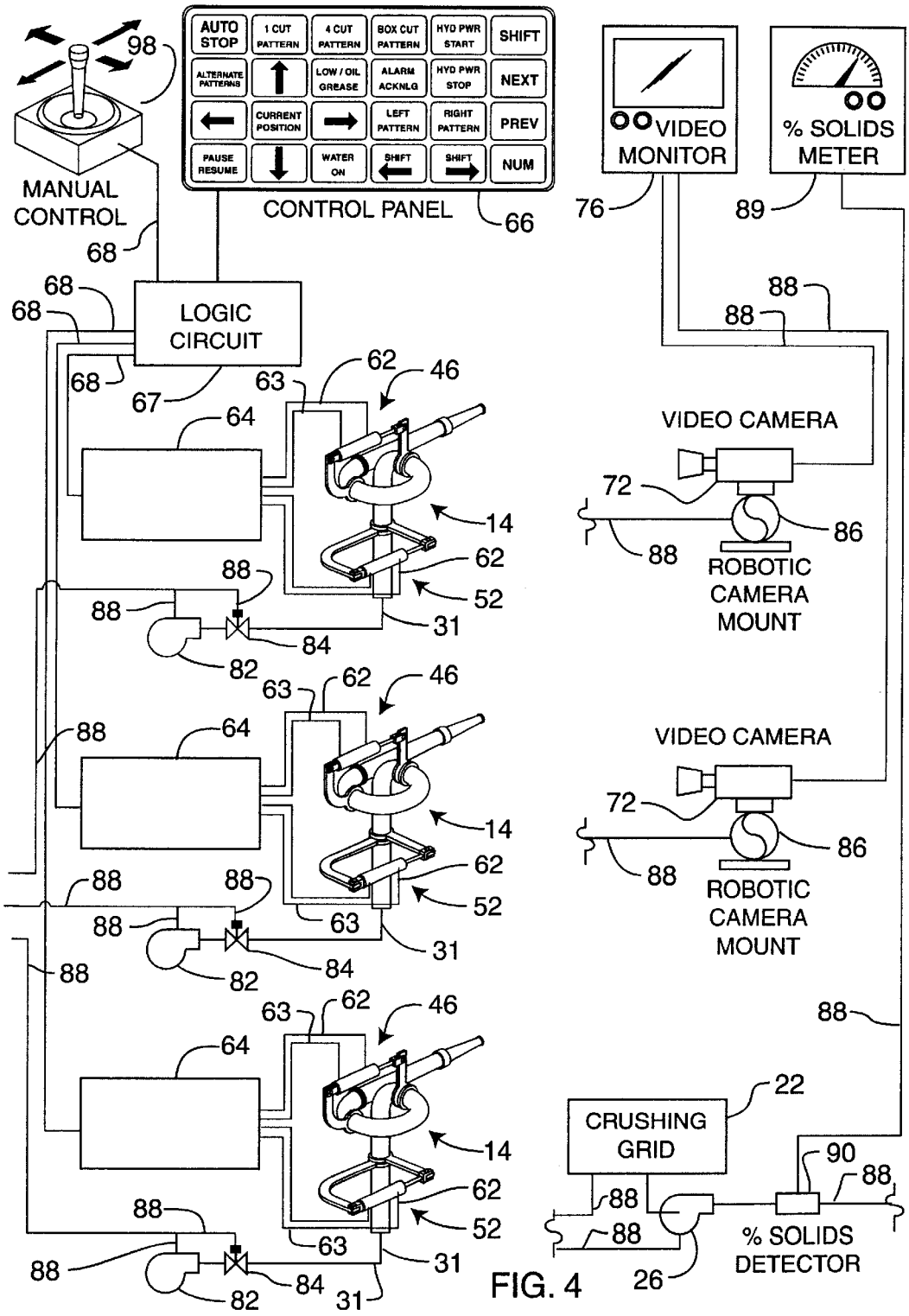
FIG. 4 is a schematic view of the control and monitor section and the automated water guns of the present invention.

Each automated water gun 14 is controlled by a control system including a control panel and control console described hereinafter. Specifically, as shown in FIG. 4, a control panel 66 including a plurality of control panel keys is coupled to logic circuitry 67 which is, in turn, operatively coupled to the pattern positioning device and a barrel shifting mechanism through a plurality of conductors or control lines each indicated as 68 to allow by an operator to control of the positioning and operating patterns of the automated water guns 14. The control panel 66 may be located in a remote control room in a vehicle generally indicated as 70 located adjacent to the slurry pit 8. The remote control room may include at least one viewing or observation window 71 for direct visual observation of the slurry pit 8 by operator. One or more video cameras each indicated as 72 mounted on corresponding telescoping camera masts 74 feed signals to a corresponding video monitor 76 for simultaneous observation of different areas of the slurry pit 8 by a single operator. Remote wireless video cameras 77 may be used in association with a corresponding video monitor 76. A plurality of floodlights each indicated as 78 may be operatively mounted to the exterior of the remote control room to facilitate nighttime operation.

Figure 5:
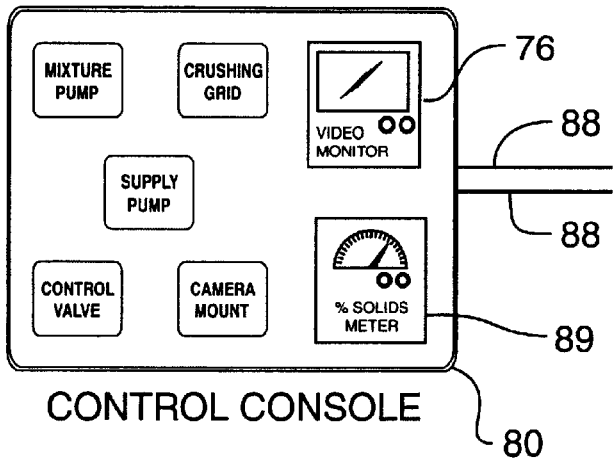
FIG. 5 is a detailed view of the control console of the present invention.

As shown in FIGS. 4 and 5, a control console 80 with logic circuitry and including a plurality of control console keys is operatively coupled to the water-mineral mixture pump 26, the crushing grid 22, a plurality of water supply pumps each indicated as 82 and a corresponding plurality of water supply control valves each indicated as 84 to supply water to each corresponding automated water gun 14, and to a robotic camera mount 86 under each video camera 72 and 77 by a plurality of corresponding conductors or control lines each indicated as 88. In addition, the control console 80 may include a percentage solids meter 89 operatively coupled to a percentage solids detector 90 which is, in turn, coupled to the water-mineral mixture pump 26.

Figure 3A:
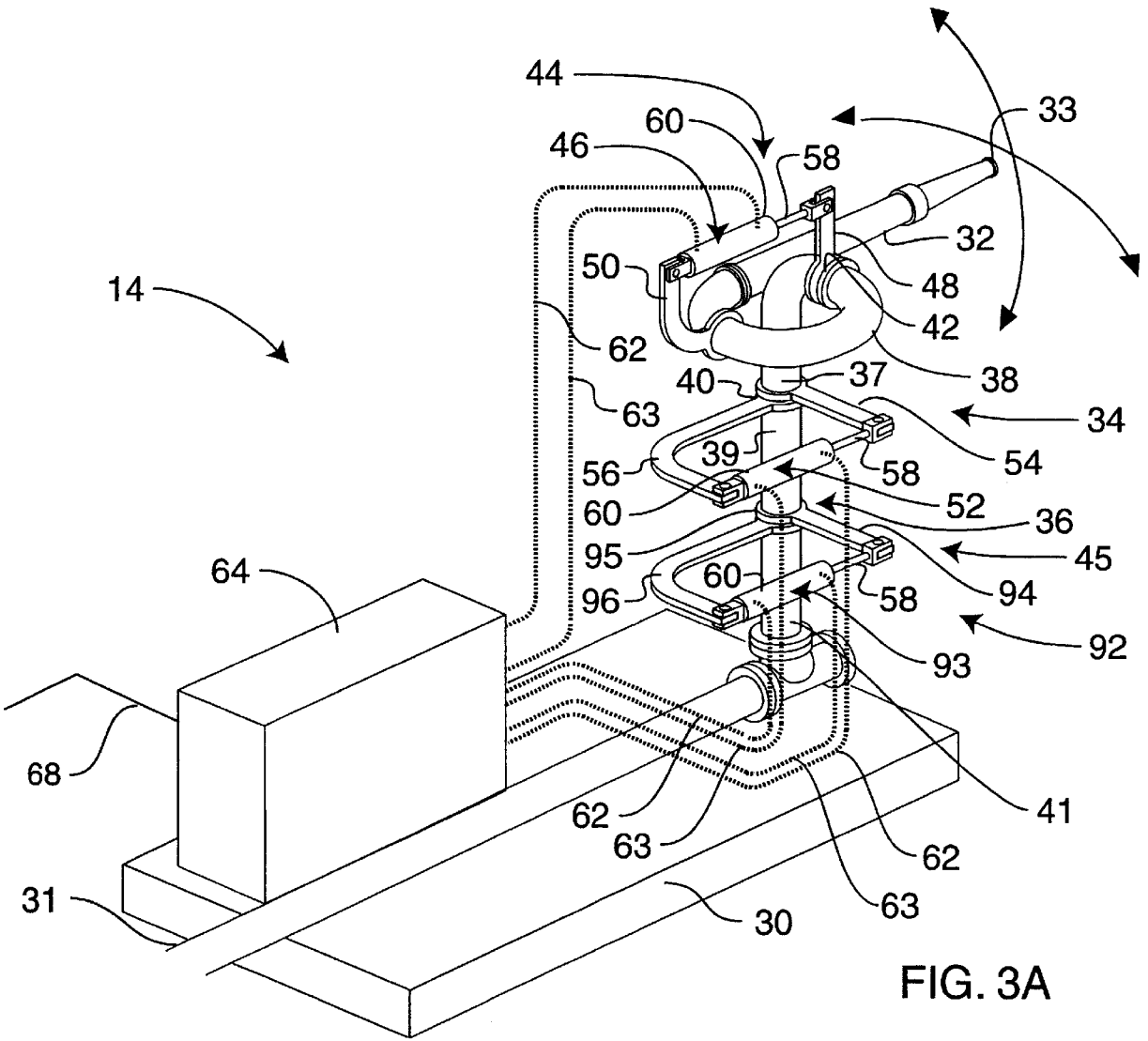
FIG. 3A is a detailed perspective view of an alternate embodiment of an automated water gun of the present invention.

As shown in FIG. 3A, the system and apparatus further includes a barrel shifting mechanism generally indicated as 92 selectably moveable through a predetermined horizontal range of substantially 105 degrees sufficient to allow water discharged from the high pressure discharge nozzle 33 to be aimed or directed selectively either toward the dry mineral stockpile 6 or the slurry pit 8.

When coordinated, an operator can use the second positioning mechanism 45 and the barrel shifting mechanism 92 together to move the corresponding water gun barrel 32 through an azimuth of 210 degrees.

The barrel shifting mechanism 92 comprises a barrel aiming assembly generally indicated as 93 pivotally disposed between a first horizontal control arm 94 rigidly attached to the lower or second tube section 39 of the substantially vertical supply tube 36 on one side of a water-tight swivel joint 95 and a second horizontal control arm 96 rigidly attached to a third tube section 41 of the substantially vertical straight supply tube 36 on the other side of the water-tight swivel joint 95. The barrel aiming assembly 93 comprises a first element or connecting rod 58 and a second element or hydraulic cylinder 60 movably coupled to each other and first and second horizontal control arms 94 and 96.

Operation of the barrel shifting mechanism 92 involves the selective introduction of high pressure hydraulic fluid to the hydraulic cylinder 60 extending or retracting the connecting rod 58. The hydraulic fluid (not shown) is supplied to the hydraulic cylinder 60 by a hydraulic supply conduit 62 and a return conduit 63 in operative communication with the hydraulic cylinder 92 and hydraulic pump (not shown) disposed within the cabinet 64 mounted on the portable sled 30. The hydraulic pump (not shown) is powered by an electric motor (not shown) also disposed within the cabinet 64. Electromechanical valves (not shown) common in the art are disposed between the hydraulic fluid supply conduit 62 and the return conduit 63 and the hydraulic pump (not shown) to control the flow of hydraulic fluid to and from the hydraulic cylinder 60.

As shown in FIGS. 4 and 5, operation of the system and apparatus is controlled by the control panel 66 and the control console 80 which selectively actuate or activate the various functions or operations of the system and apparatus corresponding to a plurality of control keys.

Figure 6:
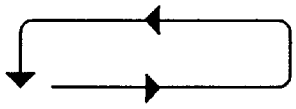
FIG. 6 depicts the profile of a predetermined water gun pattern of the present invention.
Figure 7:
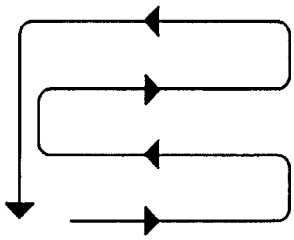
FIG. 7 depicts the profile of an alternative predetermined water gun pattern of the present invention.
Figure 8:
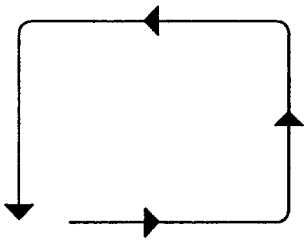
FIG. 8 depicts the profile of an alternative predetermined water gun pattern of the present invention.

As shown in FIG. 4, the first row of control panel keys on the control panel 66 comprises an AUTO STOP key to stop the automatic operation of the system and allows the operator to change patterns, a first or single CUT PATTERN to move the selected automated water gun 14 from left to right as shown in FIG. 6 where the vertical pattern is adjusted manually, a second or 4 CUT PATTERN to cut the pattern into 3 smaller sections as shown in FIG. 7, a third or BOX CUT PATTERN for a basic box pattern starting from the lower left-hand corner moving in a counter clockwise direction as shown in FIG. 8, a HYD PWR START key to turn the hydraulic power supply on and a LOCK SHIFT key to redefine the keypad in the shifted position. The LOCK SHIFT key is used to set the default values of the box pattern and to dump the hydraulic water to the slurry pit 8. The second row of control panel keys comprises an alternative patterns key to alternate pattern mode automatically changing between the right hand pattern and left hand pattern where the selected automated water gun 14 cycles between patterns in a predetermined time such as 2 minutes, an UP ARROW key to set the upper limit of the pattern, a LOW/OIL GREASE key for a low oil and the low grease alarm where the lamp will be illuminated when an alarm condition exists, an ALARM ACKNOWLEDGE key to turn off the audible alarm and a HYD PWR STOP key to turn off the hydraulic pump and auto mode and to dump the hydraulic water. The third row of control panel keys comprises a LEFT ARROW key to set the left limit of the pattern, a CURRENT POSITION key to display the current gun position for each automated water gun 14, a RIGHT ARROW key to set the right limit of the pattern, a LEFT PATTERN key to select the pit patterns and a RIGHT PATTERN key to select the pile patterns. The fourth row of control keys comprises a PAUSE/RESUME key used to temporarily interrupt the automatic operation. The operator can manually use of the gun by use of the joy stick or manual control 98. It also is used to adjust the limits of the pattern, a DOWN ARROW key to set the lower limit of the pattern, a HYD WATER ON key to close the pit water dump valve and open the hydraulic water valve to the monitor, a SHIFT LEFT key to shift the entire pattern to the left by shifting the gun, and a SHIFT RIGHT key to shift the entire pattern to the right by shifting the gun.

As shown in FIG. 5, the control console keys comprises a water-mineral mixture pump key, a crushing grid key, water supply key(s), water supply control valve key(s), robotic camera mount key(s), video camera key(s) and a system monitor including percentage solids meter 89, video monitor 76 and percentage solids detector 90.

As shown in FIGS. 6 through 8, a plurality of motion patterns are preprogrammed into the logic circuitry 67 and may be selected by keystroke input on the control panel 66. For example, for each automated water gun 14, the operator may press the key for "single cut" pattern (FIG. 6) where the water barrel 32 of the selected automated water gun 14 cycles back and forth through a horizontal plane of motion. Alternatively, the operator may depress a "4 cut" key to select a "4 cut" pattern (FIG. 7), where the water gun barrel 32 of the selected automated water gun 14 iterates through a series of 4 paths of motion through 4 parallel horizontal planes separated by incremental vertical movements. The operator may also select a "box cut" pattern (FIG. 8) where the water gun barrel 32 of the automated water gun 14 iterates through a pattern of motion including a horizontal movement followed by a vertical movement, followed by a horizontal movement, followed by a vertical movement returning the water gun barrel 32 to the starting position. As shown in FIG. 2, the automated water gun 14 may be aimed at or trained on the dry mineral stockpile 6 or the slurry pit 8 by depressing a shift left or shift←key or a shift right or shift→key respectively as shown in FIG. 4 actuating the barrel shifting mechanism.

In addition to the iterating patterns of movement described above as shown in FIG. 4, the operator may also manually control the movement of any water gun barrel 32 by selectively moving the joy stick 98 in the desired direction. It should be appreciated that other patterns of movement can also be incorporated in the automated water guns 14 of the present invention without altering the scope.

The predetermined pattern is selected or set up by turning the hydraulic power supply on, depressing the pause or auto stop key, depressing the left pattern key or right pattern key, moving the selected automated water gun 14 manually to the left and then depressing the limit set left arrow key, moving the selected automated water gun 14 manually to the right and then depressing the limit set right arrow key, moving the selected automated water gun 14 manually up and then depressing the limit set up arrow key, moving the selected automated water gun 14 manually down and then depressing the limit set down arrow key and then the depressing cut key. The pause/resume key can be used to edit the limits at any time.

In operation, the operator initiates the production of the water mineral mixture by activating the water supply key and water supply control valve key to the selected automated water gun(s) 14 and depressing the water-mineral mixture pump key and the crushing grid key on the control console 80. Upon the selection of the pattern of movement, the water gun barrel 32 of the selected automated water gun(s) 14 will continue to iterate through the selected pattern of movement until the cycle is completed or interrupted by the operator.

As shown in FIGS. 1 through 3, during the mining operation, mineral material 2 is deposited in the dry mineral stockpile 6 on the edge of the slurry pit 8 by a dragline or excavating equipment (not shown). The operator then selectively activates one or more of the water pumps 82 and valves 84 to supply each of the selected or activated automated water guns 14. High velocity streams of water 12 from each activated automated water gun 14 are directed or aimed at the dry mineral stockpile 6, the surface of the slurry pit 8 and the crushing grid 22 independently of each other. For example, high velocity streams of water 12 can be directed to the base of the dry mineral stockpile 6 in a "single cut" pattern (FIG. 6) thereby causing mineral material 2 to slough off the dry mineral stockpile 6 into the slurry pit 8. Depending upon the characteristics of the dry mineral stockpile 6, the operator may also select other patterns of movement of the water gun barrel 32 of the corresponding automated water gun 14 to adjust the rate at which mineral materials flow from the dry mineral stockpile 6 into the slurry pit 8.

Once in the slurry pit 8, mineral materials are continually mixed with water by directing high velocity streams of water 12 from one or more of the automated water guns 14 to the surface of the slurry pit 8. For example, a high velocity stream of water from a single automated water gun 14 may be directed against the surface of the slurry pit 8 in a simple box cut pattern (FIG. 8) in order to disperse water across a relatively large portion of the slurry pit 8. In the event mineral materials 2 begin to build up in a particular area of the slurry pit, the operator may select a "single cut" (FIG. 6) or a "4 cuts" pattern (FIG. 7) to direct a greater amount of water to that area to facilitate the flow of mineral materials 2 to the hydraulic pump inlet conduit 24.

In order to maintain relative uniform flow of mineral materials 2 into the hydraulic pump inlet conduit 24, the operator may direct additional high velocity streams of water to the area from the other automated water guns 14, using complementary combinations of patterns of motion to create desired currents of mineral materials.

In addition, through the manipulation of control keys on the control panel 66 or a continuous stream of high velocity water 12 may be directed at a specific stored location within the slurry pit 8 to remove blockage in the flow of mineral materials 2 into the hydraulic pump inlet conduit 24. For example, naturally occurring debris within the mineral materials 2 such as clay balls may accumulate on the crushing grid 22 can be removed periodically by directing a high velocity stream of water 12 to the outer surface of the crushing grid 22. A high velocity stream of water 12 may also be directed to the hydraulic pump inlet conduit 24 periodically to adjust the ratio of water to mineral material 2 in the colloidal like water-mineral mixture 20.

In order to manage the production of colloidal like water-mineral mix 2, the operator monitors the flow of mineral materials 2 both in the slurry pit 8 and within the water-mineral mixture supply conduit 28. Initially, the operator manipulates the video camera masts 74 and robotic camera mounts 86 to train the video cameras 72 at selected areas within the slurry pit 8. In addition, the operator monitors the percentage solids in the mineral-water mixture supply conduit 28 with a percentage solids meter 89 operatively coupled to a percentage solids detector 90 disposed in the mineral-water mixture supply conduit 28.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described.

What is claimed is:

1. An automated hydraulic mining system for producing and transporting a colloidal like mixture of mineral material and water from a mining site to a processing facility through a mineral delivery conduit comprising at least one automated water gun discharging continuous high velocity streams of water into a mineral stockpile and slurry pit in a plurality of predetermined undulating patterns to facilitate the mixing and movement of the colloidal like mineral material and water mixture through the slurry pit into a pump inlet disposed within the slurry pit, said automated water gun having a barrel selectively moveable through one of said predetermined undulating patterns of vertical and horizontal motion by a vertical positioning device and a horizontal positioning device respectively.

2. The automated hydraulic mining system of claim 1 including a first automated water gun positioned on one side of said slurry pit and a second automated water gun positioned on the opposite side of the slurry pit.

3. The automated hydraulic mining system of claim 1 wherein each said automated water guns are mounted on a portable sled in operative communication with a portable water supply conduit.

4. The automated hydraulic mining system of claim 1 wherein said barrel is formed on an articulated water supply pipe comprising a substantially vertical straight supply tube with an integral substantially horizontal water tight swivel joint and a substantially horizontal curvilinear supply tube with an integral water tight swivel joint.

5. The automated hydraulic mining system of claim 4 wherein said vertical positioning device comprises a positioning mechanism coupled between a first vertical control arm rigidly attached to said substantially horizontal curvilinear supply tube on one side of said second water-tight swivel joint and a second vertical control arm rigidly attached to said substantially horizontal curvilinear supply tube on the other side of said second water-tight swivel joint and wherein said horizontal positioning device comprises a positioning mechanism coupled between a first horizontal positioning arm rigidly attached to the substantially vertical straight supply tube on one side of said substantially horizontal water tight swivel joint and a second horizontal control arm rigidly attached to the substantially vertical straight supply tube on the opposite side of said substantially horizontal water tight swivel joint.

6. The automated hydraulic mining system of claim 5 where said vertical positioning device and said horizontal positioning device are operatively coupled to a hydraulic power supply.

7. The automated hydraulic mining system of claim 4 further including water gun control commands include a plurality of discrete sets of control commands, each discrete set of control commands producing a cyclic pattern of movement of the barrel of said automated water gun wherein movement the barrel of the automated water gun is initiated at a beginning point and progresses through a predetermined pattern of horizontal and vertical movement returning the barrel to the point of beginning at the end of the pattern.

8. The automated hydraulic mining system of claim 7 further including a control circuit with a series of control commands actuated by key switches which allow a human operator to selectively choose and initiate a pattern of movement for said automated water gun.

9. The automated hydraulic mining system of claim 8 wherein said control circuit includes a series of control commands actuated by key switches which allow a human operator to selectively modify the range of horizontal and vertical movement in said predetermined patterns of motion.

10. The automated hydraulic mining system of claim 9 wherein said control circuit includes a series of control commands actuated by key switches which allow a human operator to selectively modify the center of horizontal and vertical movement in said predetermined patterns of motion such that a particular pattern of motion can be directed to a particular area of said slurry pit.

11. The automated hydraulic mining system of claim 10 wherein said control circuit includes a series of control commands actuated by key switches which allow a human operator to manually control the movement of said barrel in real time through a control input means comprising a joy stick or a plurality of directional keys.

12. The automated hydraulic mining system of claim 11 including a monitoring means comprising at least one video camera focused on said automated water guns and the surrounding area operatively coupled to a video displayed disposed within said remote control room.

13. The automated hydraulic mining system of claim 12 wherein said video camera is mounted on a robotic camera mount disposed on a telescoping mast mounted on said remote control room, said robotic camera mount being operatively coupled to a control circuit disposed at said remote site.

14. The automated hydraulic mining system of claim 13 wherein said monitoring means includes a percentage solids detector disposed in or around said mineral delivery conduit to detect the percentage of the mineral material therein, said percentage solids detector being operatively coupled to a percentage solids meter disposed within said remote site comprises a control room.

15. The automated hydraulic mining system of claim 14 wherein said remote control room is mounted on a truck or all terrain vehicle.

16. The automated hydraulic mining system of claim 15 wherein said pump inlet is disposed behind a crushing grid within said slurry pit.

17. The automated hydraulic mining system of claim 16 including a third automated water gun disposed adjacent to the first automated water gun.

18. The automated hydraulic mining system of claim 1 including a pattern positioning device comprising a first positioning mechanism and a second positioning mechanism to selectively move through one of said predetermined undulating patterns or directed against the dry mineral stockpile or the surface of the slurry.

19. The automated hydraulic mining system of claim 18 wherein each automated water gun includes a water gun barrel with a discharge nozzle formed on an articulated supply pipe comprising a straight substantially vertical supply tube including a first supply tube section and a second supply tube section and a curvilinear supply tube; a first water-tight swivel joint formed in the first supply tube section and a second water-tight swivel joint formed in said curvilinear supply tube for selective articulation of said first water-tight swivel joint and said second water-tight swivel joint such that said water gun barrel is moveable through a selectable range of vertical and horizontal motion.

20. The automated hydraulic mining system of claim 19 wherein first positioning mechanism comprising a first positioning assembly operatively coupled between a first control arm attached to said curvilinear supply tube on one side of said second water-tight swivel joint and a second control arm coupled to said curvilinear supply tube on the other side of said second water-tight swivel joint and said second positioning mechanism comprising a second positioning assembly operatively coupled between a first control arm rigidly attached to said first supply tube section on one side of said first water-tight swivel joint and a second horizontal control arm rigidly attached to the supply tube section on the other side of the first water-tight swivel joint.

21. The automated hydraulic mining system of claim 20 wherein each positioning assembly comprises a first element rod and a second element movably coupled to each other and to the corresponding first and second vertical control assembly and the corresponding first and second horizontal control arms.

22. The automated hydraulic mining system of claim 18 further includes a barrel shifting mechanism selectably moveable through a predetermined horizontal range sufficient to allow water discharged from said discharge nozzle to be aimed or directed selectively either toward the dry mineral stockpile or the slurry pit.

23. The automated hydraulic mining system of claim 1 including a pattern positioning device comprising a first positioning mechanism and a second positioning mechanism to selectively move through one of said predetermined undulating patterns or directed against the dry mineral stockpile, the surface of the slurry.

24. The automated hydraulic mining system of claim 23 wherein each automated water gun includes a water gun barrel with a discharge nozzle formed on an articulated supply pipe comprising a straight substantially vertical supply tube including a first supply tube section and a second supply tube section and a curvilinear supply tube; a first water-tight swivel joint formed in the first supply tube section and a second water-tight swivel joint formed in said curvilinear supply tube for selective articulation of said first water-tight swivel joint and said second water-tight swivel joint such that said water gun barrel is moveable through a selectable range of vertical and horizontal motion.

25. The automated hydraulic mining system of claim 24 wherein first positioning mechanism comprising a first positioning assembly operatively coupled between a first control arm attached to said curvilinear supply tube on one side of said second water-tight swivel joint and a second control arm coupled to said curvilinear supply tube on the other side of said second water-tight swivel joint and said second positioning mechanism comprising a second positioning assembly operatively coupled between a first control arm rigidly attached to said first supply tube section on one side of said first water-tight swivel joint and a second horizontal control arm rigidly attached to the supply tube section on the other side of the first water-tight swivel joint.

26. The automated hydraulic mining system of claim 25 wherein each positioning assembly comprises a first element rod and a second element movably coupled to each other and to the corresponding first and second vertical control assembly and the corresponding first and second horizontal control arms.

* * * * *